US006220923B1

(12) United States Patent
Lin

(10) Patent No.: US 6,220,923 B1
(45) Date of Patent: Apr. 24, 2001

(54) ARTIFICIAL EYEBALL FOR A DOLL

(76) Inventor: Hong-Tien Lin, No. 184, Hua-Kang St., Pa-Te City, Taoyuan Hsien (TW)

( * ) Notice: Subject to any disclaimer, the term of this patent is extended or adjusted under 35 U.S.C. 154(b) by 0 days.

(21) Appl. No.: 09/602,853

(22) Filed: Jun. 26, 2000

(51) Int. Cl.[7] ..... A63H 3/38; A63H 3/40
(52) U.S. Cl. ..... 446/392; 446/343
(58) Field of Search ..... 446/391, 392, 446/343, 344, 345, 346, 349, 330

(56) References Cited

U.S. PATENT DOCUMENTS 3,664,059 * 5/1972 Leibowitz ..... 446/343
4,737,132 * 4/1988 Shunsaku ..... 446/348
4,761,150 * 8/1988 Lautenberger et al. ..... 446/345
4,775,352 * 10/1988 Curran et al. ..... 446/301
4,842,566 * 6/1989 Nagao ..... 446/345
4,900,289 * 2/1990 May et al. ..... 446/342
5,281,183 * 1/1994 Bernhardt ..... 446/345
5,609,340 * 3/1997 Chuang ..... 446/330
5,855,502 * 1/1999 Truchsess ..... 446/301

* cited by examiner

*Primary Examiner*—Jacob K. Ackun, Jr.
*Assistant Examiner*—Faye Francis
(74) *Attorney, Agent, or Firm*—Alan Kamrath; Rider, Bennett, Egan & Arundel, LLP

(57) ABSTRACT

An artificial eyeball for a doll includes a base fitted in an eye socket of a doll, an eye globe pivotally connected with the base, and a set of electromagnets provided in the base. The set of electromagnets has a first iron core and a second iron core respectively extending in a corresponding first electric coil and a corresponding second electric coil. The eye globe has first and second magnets secured therein and corresponding to a first iron core and a second iron core. As the first magnet is inclined to the second magnet, when the first and second electric coils respectively and alternately have reversed currents passing therethrough, the eyeball of the doll is able to wink naturally.

6 Claims, 4 Drawing Sheets

ARTIFICIAL EYEBALL FOR A DOLL

BACKGROUND OF THE INVENTION

1. Field of the Invention

The present invention relates to an artificial eyeball for a doll, particularly an artificial eyeball which is controllable to wink by means of electromagnets provided in the eyeball.

2. Description of Related Art

Dolls have been loved by children all over the world since the beginning of civilization. One kind of conventional doll has a pair of winking eyes. When the doll is laid down, the eyes of the doll are closed. When the doll is stood up, the eyes of the doll are open. Children enjoy playing with this kind of doll, however as the eyes can only mechanically close or open when the doll is laid down or stood up, it's appeal to sophisticated modern children is very limited.

Therefore, it is an objective of the invention to provide an improved eyeball of a doll to mitigate and/or obviate the aforementioned problems.

SUMMARY OF THE INVENTION

The object of the present invention is to provide an artificial eyeball of a doll, the eyeball comprising a base fitted in an eye socket of the doll, an eye globe pivotally connected with the base, and a set of electromagnets provided in the base, whereby the eyeball is electrically controllable to wink by means of the electromagnets, and the doll fitted with this kind of eyeball will wink naturally and in an interesting way to attract customers.

The detailed features of the present invention will be apparent in the detailed description with appropriate reference to the accompanying drawings.

DETAILED DESCRIPTION OF THE PREFERRED EMBODIMENT

Figure 1:
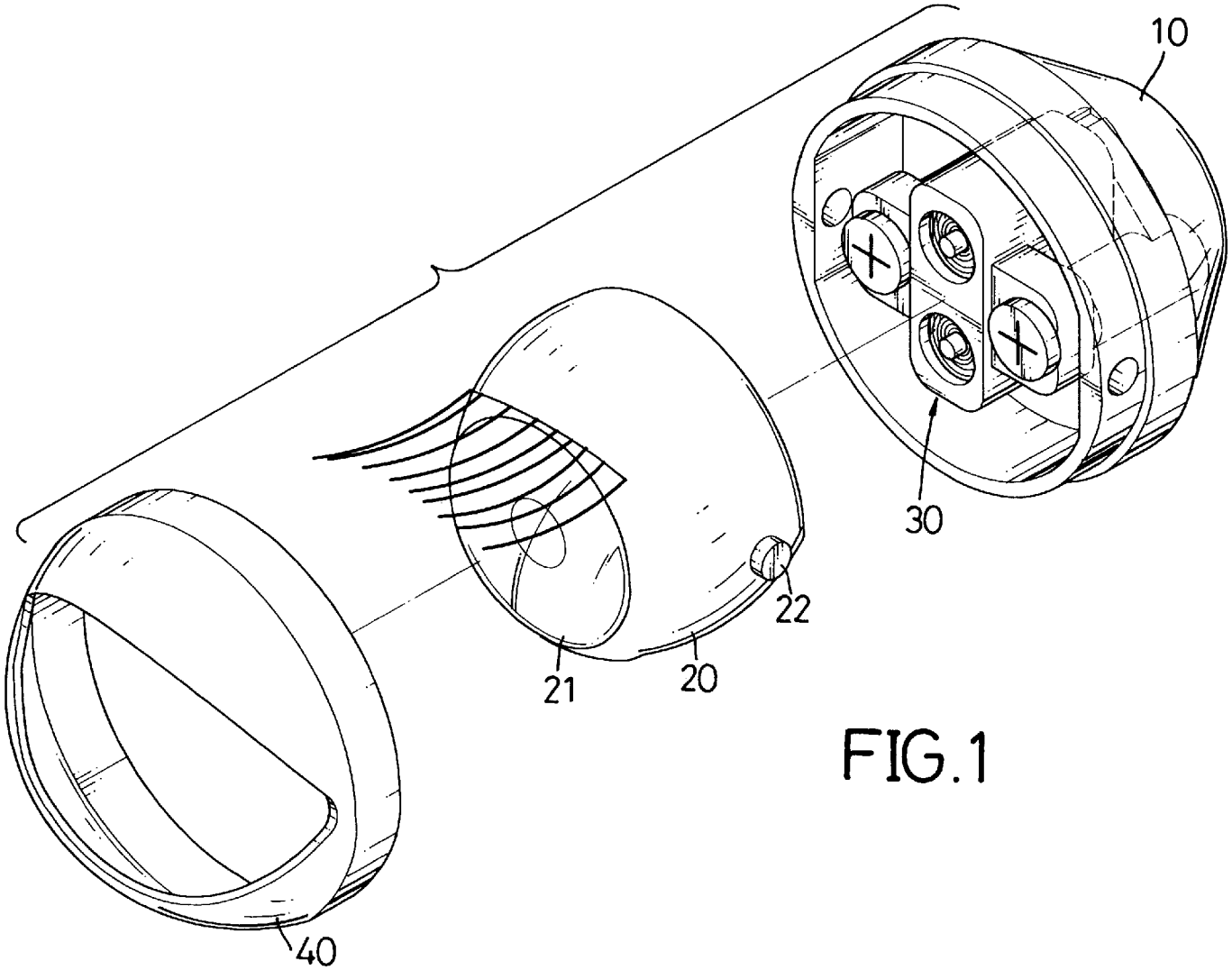
FIG. 1 is a perspective view of an artificial eyeball for a doll in accordance with the present invention.

As shown in FIG. 1, the present invention relates to an artificial eyeball for a doll. The eyeball comprises a base (10) fitted in an eye socket of the doll, an eye globe (20) pivotally connected with the base (10), a set of electromagnets (30) provided in the base (10), and a lid (40) enclosing the globe (20) and attached to the base (10).

Figure 2:
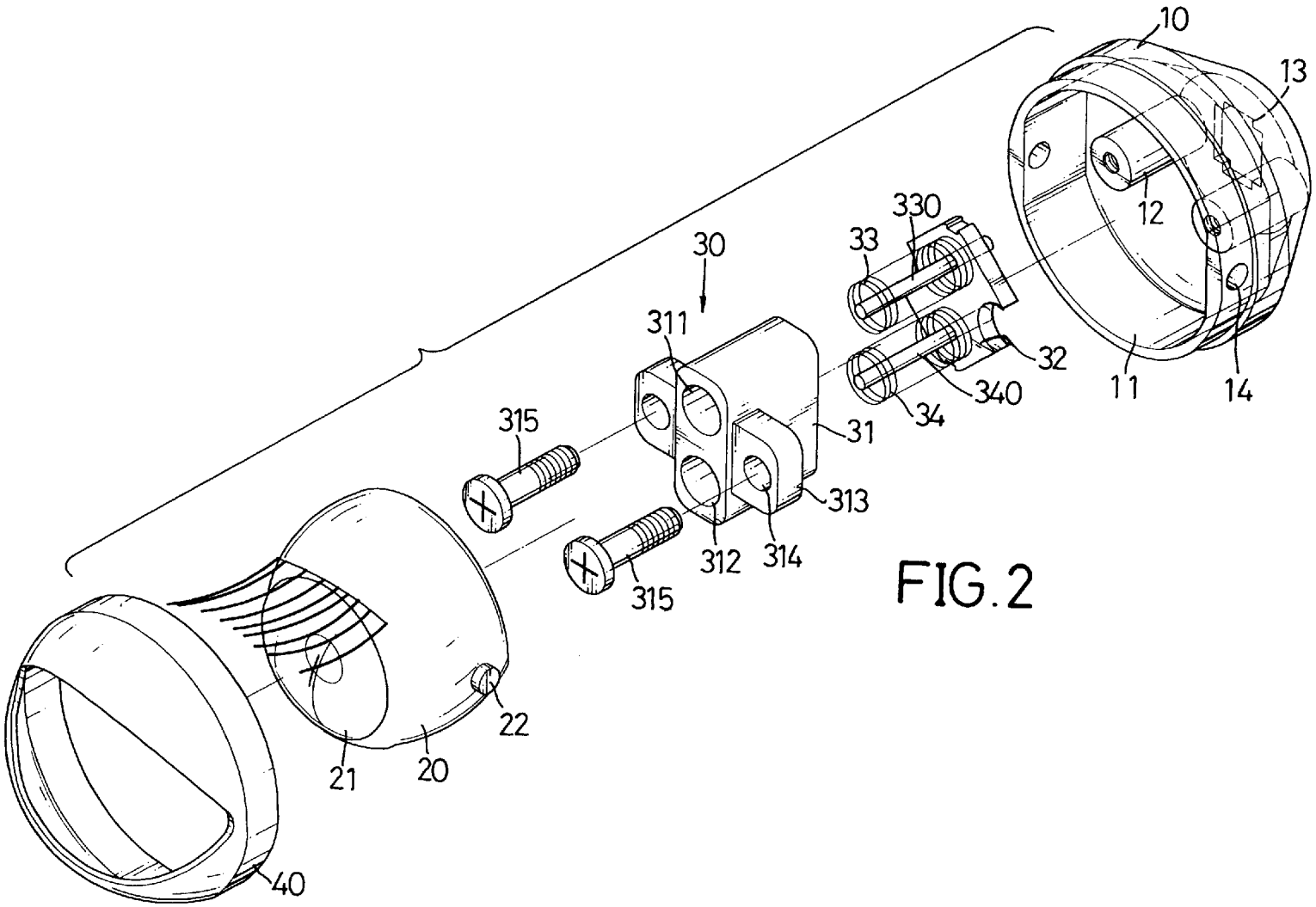
FIG. 2 is a perspective exploded view of the artificial eyeball in accordance with the present invention.

Referring to FIG. 2, the base (10) is substantially hemispherical and defines a recess (11) to receive the set of electromagnets (30). Two fixing posts (12) are integrally formed at opposite sides of a bottom of the recess (11) and parallel to the each other. Each fixing post (12) has a screw hole defined therein. An opening (13) is defined in the bottom of the recess (11) between the two fixing posts (12). The base (10) further has two pivot holes (14) respectively defined at opposite sides of an open end of the recess (11).

Figure 3:
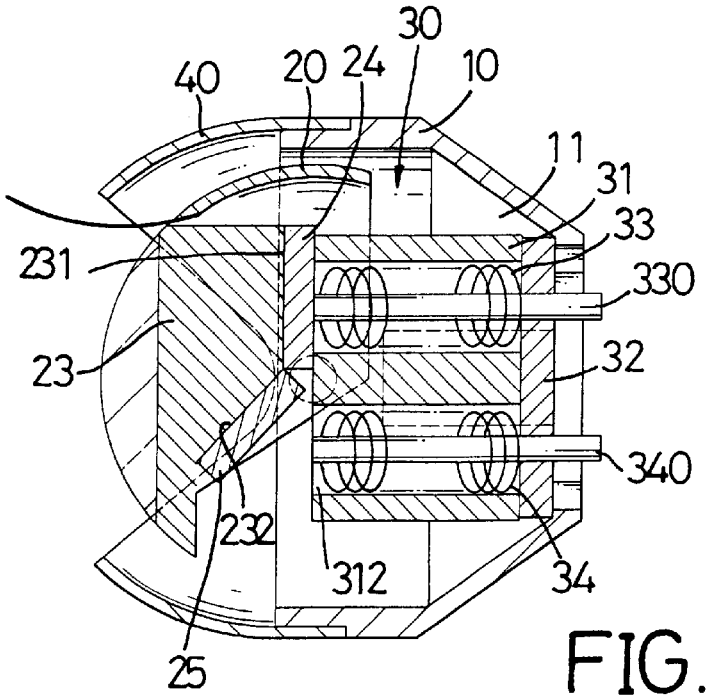
FIG. 3 is a cross sectional side view of the artificial eyeball in accordance with the present invention, showing its opened situation.

The eye globe (20) is formed in a hemispherical shape, and has an eye's pattern (21) on an outer surface thereof The eye pattern (21) may be painted on, molded in or adhered as a decal. The eye globe (20) is formed with two pivots (22) at opposite sides thereof corresponding to the pivot holes (14) of the base (10). As best shown in FIG. 3, a block (23) secured on an inner surface of the eye globe (20) has an outside thereof formed with a first plane (231) and a second plane (232) which is inclined to the first plane (231). The first plane (231) is secured with a first magnet (24) and the second plane (232) is secured with a second magnet (25).

The set of electromagnets (30) consists of a body (31), a circuit board (32), first and second electric coils (33, 34) which are respectively received in the body (31), and a first and a second iron core (330, 340) which are respectively extended in the first and second electric coils (33, 34).

The body (31) is defined with first and second through holes (311, 312) to respectively receive the first and the second electric coils (33, 34) therein. Opposite sides of the body (31) are respectively formed with two lugs (313), which are respectively defined with two fixing holes (314) therein corresponding to the screw holes of the fixing posts (12). Two bolts (315) are respectively extended through the fixing holes (314) and screwed into the screw holes of the fixing posts (12) to fix the body (31) on the base (10).

The circuit board (32) is fixed on the bottom of the recess (11) of the base (10) between the two fixing posts (12). The first and second iron cores (330, 340) have two first ends thereof respectively secured on the circuit board (32) and two second ends thereof respectively extended in the first and the second electric coils (33, 34).

The first and second electric coils (33, 34) are respectively and electrically connected with the circuit board (32). Electrical wires are connected with the circuit board (32) and extended through the opening (13) of the base (10) to the outside.

Figure 4:
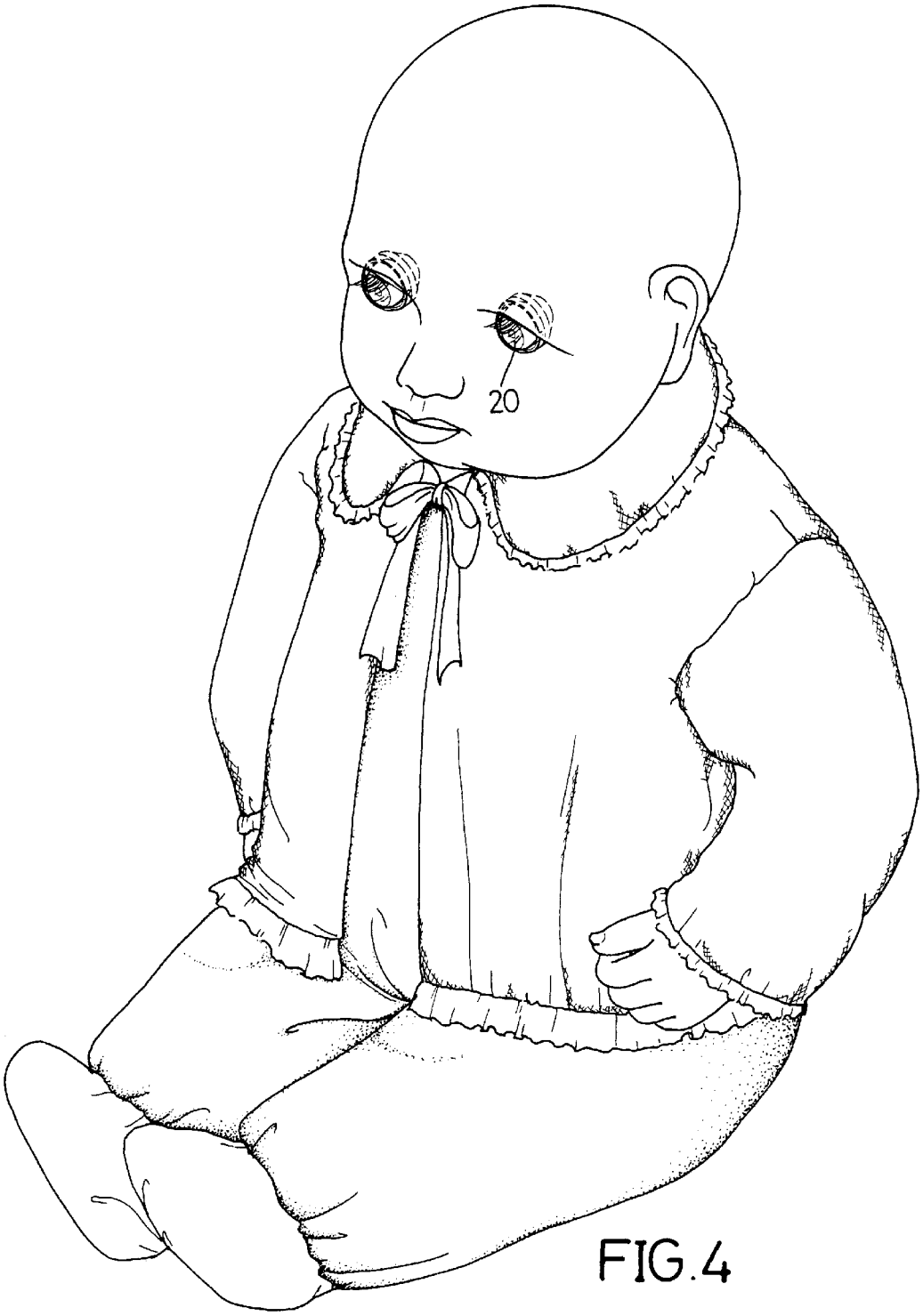
FIG. 4 is a schematic view of the artificial eyeball fitted in a doll.

Referring to FIG. 4, a pair of artificial eyeball of present invention is fitted in the doll, which has a head with a pair of socket (51) defined therein to receive the eyeballs.

Figure 5:
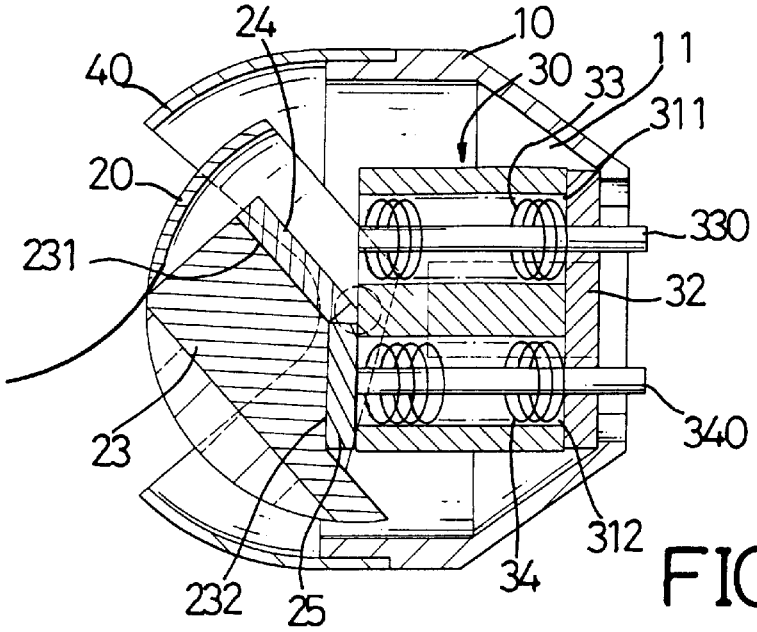
FIG. 5 is a cross sectional side view of the artificial eyeball in accordance with the present invention, showing its closed situation.

As shown in FIGS. 3 and 5, when the first electric coil (33) has a current passing there through, the first iron core (330) is excited to attract or repel the corresponding first magnet (24), which has a reversed polarity or a same polarity to the first iron core (330). Meanwhile the second electric coil (34) has no current or has a reverse current passing there through, such that the second iron core (34) is not excited or is excited to repel or attract the corresponding second magnet (25), which has a same polarity or a reversed polarity to the second iron core (340). The first and second electric coils (33, 34) respectively and alternately have reversed currents passing therethough, the first and second magnets (24, 25) are alternately attracted or repelled by the first and second iron core (330, 340), and the eye globe (23) is pivoted at the pivots (22), and thus the eyeball winks in a natural style.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An artificial eyeball for a doll, comprising a base (10) for fitting in an eye socket of the doll, an eye globe (20)

pivotally connected with the base (10), and a set of electromagnets (30) provided in the base (10), wherein the set of electromagnets (30) has a first electric coil (33) and a second electric coil (34) received therein and a first iron core (330) and a second iron core (340) respectively extending in the corresponding first and second electric coils (33, 34);

the eye globe (20) has a first magnet (24) and a second magnet (25) secured therein corresponding to the first and second iron cores (330, 340); and the first magnet (24) is inclined to the second magnet (25).

2. The artificial eyeball for a doll as claimed in claim 1, wherein the base (10) is formed in a substantially hemispherical shape and has a recess (11) defined therein, two fixing posts (12) integrally formed on a bottom of the recess (11) and parallel to the each other, and an opening (13) defined in the bottom of the recess (11).

3. The artificial eyeball for a doll as claimed in claim 1, wherein the eye globe (20) is formed in a substantially hemispherical shape and has an eye pattern (21) on an outer surface thereof, two pivots (22) respectively formed at opposite sides thereof and corresponding to two pivot holes (14) defined at opposite side of the opening end of the recess (11), and a block (23) secured in an inner surface thereof with the first and second magnets (24, 25) respectively secured thereon and corresponding to the first and second iron cores (330, 340) of the set of electromagnets (30).

4. The artificial eyeball for a doll as claimed in claim 1, wherein the set of electromagnets (30) has a body (31) which is defined with two through holes (311) therein to respectively receive the first and second electric coils (33, 34) therein, a circuit board (32) electrically connected with the first and second electric coils (33, 34), the first and second iron cores (330, 340) having two first ends respectively secured on the circuit board (32) and two second ends respectively extending in the corresponding first and second electric coils (33, 34).

5. The artificial eyeball for a doll as claimed in claim 4, wherein the body (31) has two lugs (313) formed at opposite sides thereof respectively with two fixing holes (314) defined therein corresponding to two screw holes defined in the two fixing posts (12) of the base (10), two bolts (315) are respectively extended through the fixing holes (314) and screwed into the corresponding screw holes defined in the fixing posts (12) of the base (10).

6. The artificial eyeball for a doll as claimed in claim 1, wherein a lid (40) enclosing the globe (20) is attached to the base (10).

* * * * *